US012583661B2

(12) United States Patent
Liao et al.

(10) Patent No.: US 12,583,661 B2
(45) Date of Patent: Mar. 24, 2026

(54) CHIP STORING DEVICE

(71) Applicants: GLOBAL UNICHIP CORPORATION, Hsinchu City (TW); TAIWAN SEMICONDUCTOR MANUFACTURING COMPANY, LTD., Hsinchu (TW)

(72) Inventors: Chih-Chieh Liao, Hsinchu City (TW); Yu-Min Sun, Hsinchu City (TW); Chih-Feng Cheng, Hsinchu City (TW)

(73) Assignees: GLOBAL UNICHIP CORPORATION, Hsinchu City (TW); TAIWAN SEMICONDUCTOR MANUFACTURING COMPANY, LTD., Hsinchu (TW)

( * ) Notice: Subject to any disclaimer, the term of this patent is extended or adjusted under 35 U.S.C. 154(b) by 219 days.

(21) Appl. No.: 18/456,535

(22) Filed: Aug. 28, 2023

(65) Prior Publication Data

US 2025/0033855 A1 Jan. 30, 2025

(30) Foreign Application Priority Data

Jul. 24, 2023 (TW) ..... 112127553

(51) Int. Cl.
*B65D 81/05* (2006.01)
*B65D 25/04* (2006.01)
(Continued)

(52) U.S. Cl.
CPC ..... *B65D 81/052* (2013.01); *B65D 25/04* (2013.01); *B65D 81/2015* (2013.01);
(Continued)

(58) Field of Classification Search
CPC ..... B65D 81/052; B65D 81/2015; B65D 2581/051; B65D 2585/30; B65D 85/38;
(Continued)

(56) References Cited

U.S. PATENT DOCUMENTS 7,410,060 B2 * 8/2008 Crisp ..... H01L 21/67333 206/706
7,882,957 B2 * 2/2011 Ochi ..... B65D 21/0233 206/711
(Continued)

FOREIGN PATENT DOCUMENTS

CN 1610638 A 4/2005
TW 1590994 B 7/2017
TW 201727804 A 8/2017

*Primary Examiner* — Steven A. Reynolds
(74) *Attorney, Agent, or Firm* — CKC & Partners Co., LLC

(57) ABSTRACT

A chip storing device includes a supporting frame, an elastic airbag and an airtight container. The supporting frame includes a loading tray having a receiving slot and a positioning portion. The receiving slot is used for containing a packaged chip. The positioning portion is disposed within the receiving slot, and used for limiting the elastic airbag. The airtight container is formed with an accommodating space therein. The supporting frame and the elastic air bag are completely received within the accommodation space. when the accommodation space is evacuated to be in a negative pressure environment, the volume of the elastic airbag is increased in the negative pressure environment, so that the elastic airbag that is inflated directly abuts against the packaged chip within the receiving slot.

19 Claims, 7 Drawing Sheets

(51) Int. Cl.
*B65D 81/20* (2006.01)
*B65D 85/38* (2006.01)

(52) U.S. Cl.
CPC ..... *B65D 85/38* (2013.01); *B65D 2581/051* (2013.01); *B65D 2585/30* (2013.01)

(58) Field of Classification Search
CPC ..... B65D 25/04; H01L 21/67333; H01L 21/67369; H01L 21/67359; H01L 21/67386; H01L 21/67379
USPC ..... 206/522, 454, 710, 712, 706
See application file for complete search history.

(56) References Cited

U.S. PATENT DOCUMENTS

| | | | | |
|---|---|---|---|---|
| 8,603,860 | B2 * | 12/2013 | Chen | H01L 24/81 438/106 |
| 8,708,145 | B2 * | 4/2014 | Kuo | H01L 21/67369 211/41.18 |
| 9,881,822 | B2 * | 1/2018 | Kim | H01L 21/67333 |
| 2012/0280404 | A1 * | 11/2012 | Kwon | H01L 21/565 257/E23.141 |
| 2013/0118124 | A1 * | 5/2013 | Cheah | B65D 85/00 53/410 |

* cited by examiner

CHIP STORING DEVICE

RELATED APPLICATIONS

This application claims priority to Taiwan Application Serial Number 112127553, filed on Jul. 24, 2023, which is herein incorporated by reference in its entirety.

BACKGROUND

Field of Disclosure

The present disclosure relates to a storing device. More particularly, the present disclosure relates to a chip storing device.

Description of Related Art

Generally, due to the high weight of large-sized packaged chips, during the transportation/handling of a large number of packaged chips, the gravity, vibration and friction between packaged chips will often cause pressure on the substrate of the packaged chip, thereby increasing the risk of the substrate of the package chip being cracked.

Therefore, the above-mentioned technology apparently is still with inconvenience and defects and needed to be further develop. Hence, how to develop a solution to improve the foregoing deficiencies and inconvenience is an important issue that relevant persons engaged in the industry are currently unable to delay.

SUMMARY

One aspect of the present disclosure is to provide a chip storing device for solving the difficulties mentioned above in the prior art.

In one embodiment of the present disclosure, a chip storing device includes a supporting frame, at least one first elastic airbag and an airtight container. The supporting frame includes a first loading tray having a first tray body, at least one first receiving slot and at least one positioning portion. The first receiving slot is formed on a top surface of the first tray body for containing a first packaged chip, and the positioning portion is disposed within the first receiving slot. The first elastic airbag is constrained to the positioning portion. The airtight container has an accommodating space therein, and the supporting frame and the first elastic airbag are completely received within the accommodating space. When the accommodation space is evacuated to be in a negative pressure environment, a volume of the first elastic airbag is increased in the negative pressure environment, so that the first elastic airbag that is inflated directly abuts against the first packaged chip within the first receiving slot.

In one embodiment of the present disclosure, a chip storing device includes an airtight container, a supporting frame and at least one cushioning element. The airtight container has an accommodating space therein. The supporting frame includes a plurality of loading trays stacked one another and completely received within the accommodating space. Each of the loading trays includes a tray body, at least one receiving slot, at least one penetration portion and at least one lid plate. The receiving slot is formed on a top surface of the tray body for containing a packaged chip. The penetration portion is disposed on a trough bottom of the receiving slot, and provided with a first groove and a second groove which are in communication to each other. The first groove is in communication with the receiving slot, and the second groove is formed on a bottom surface of the tray body, and the lid plate removably covers the packaged chip. The cushioning element includes a first elastic airbag and a second elastic airbag which are connected to each other. The first elastic airbag is constrained on the first groove of one of the loading trays, and the second elastic airbag is constrained on the second groove of the one of the loading trays. When the accommodation space is evacuated to be in a negative pressure environment, a volume of the first elastic airbag and a volume of the second elastic airbag are increased in the negative pressure environment, so that the first elastic airbag that is inflated directly abuts against the packaged chip located within the one of the loading trays, and the second elastic airbag that is inflated directly abuts against the lid plate within another of the loading trays.

Thus, through the construction of the embodiments above, the disclosure is able to reduce the risks of the package chip being cracked during the transportation/handling of the large-sized packaged chips, thereby reducing the transporting cost of packaged chips.

The above description is merely used for illustrating the problems to be resolved, the technical methods for resolving the problems and their efficacies, etc. The specific details of the present disclosure will be explained in the embodiments below and related drawings.

BRIEF DESCRIPTION OF THE DRAWINGS

The accompanying drawings are included to provide a further understanding of the present disclosure, and are incorporated in and constitute a part of this specification. The drawings illustrate embodiments of the present disclosure and, together with the description, serve to explain the principles of the present disclosure.

DESCRIPTION OF THE EMBODIMENTS

Figure 1:
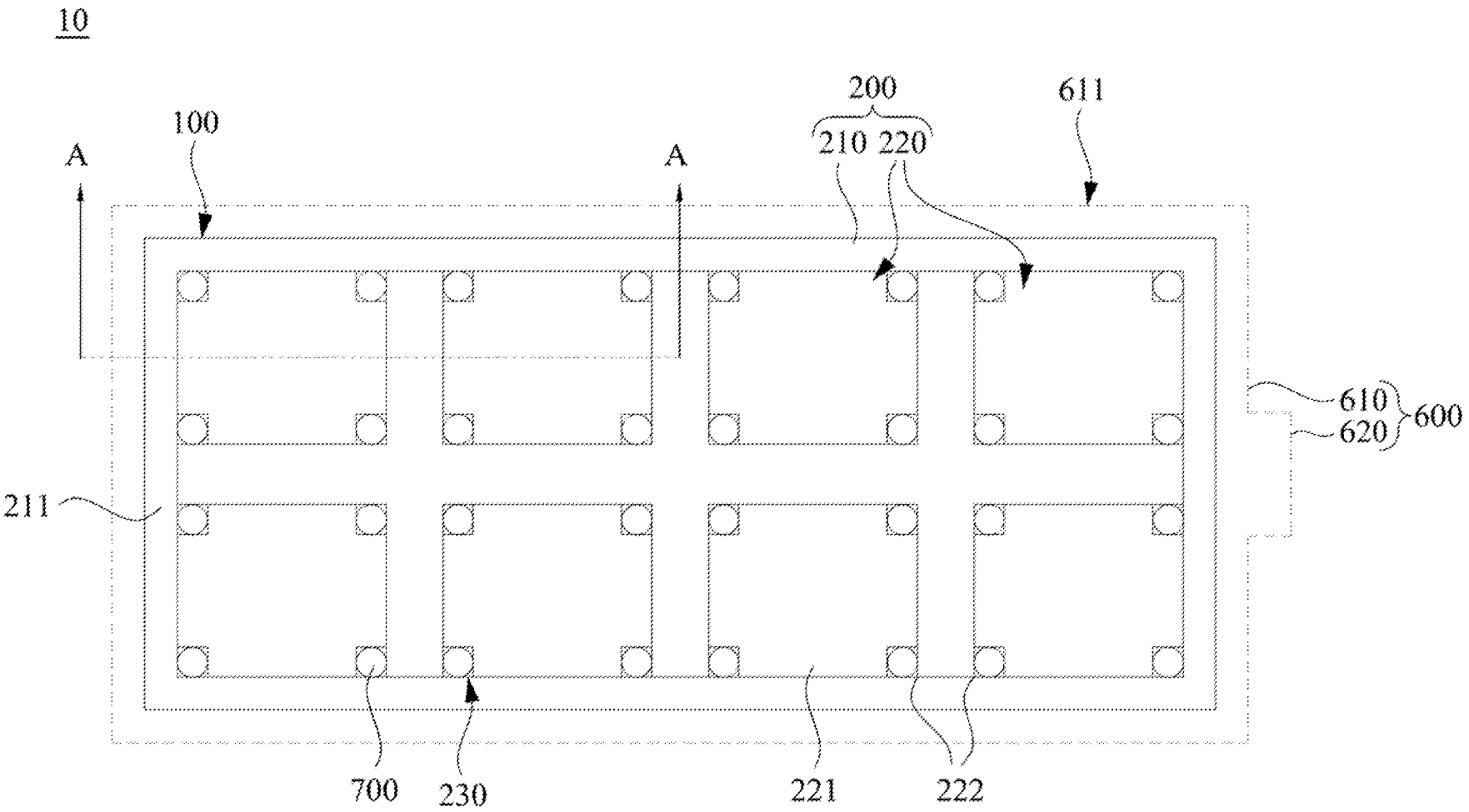
FIG. 1 is a top view of a chip storing device according to one embodiment of the present disclosure.

Reference will now be made in detail to the present embodiments of the present disclosure, examples of which are illustrated in the accompanying drawings. Wherever possible, the same reference numbers are used in the drawings and the description to refer to the same or like parts. According to the embodiments, it will be apparent to those skilled in the art that various modifications and variations can be made to the structure of the present disclosure without departing from the scope or spirit of the present disclosure.

Figure 2:
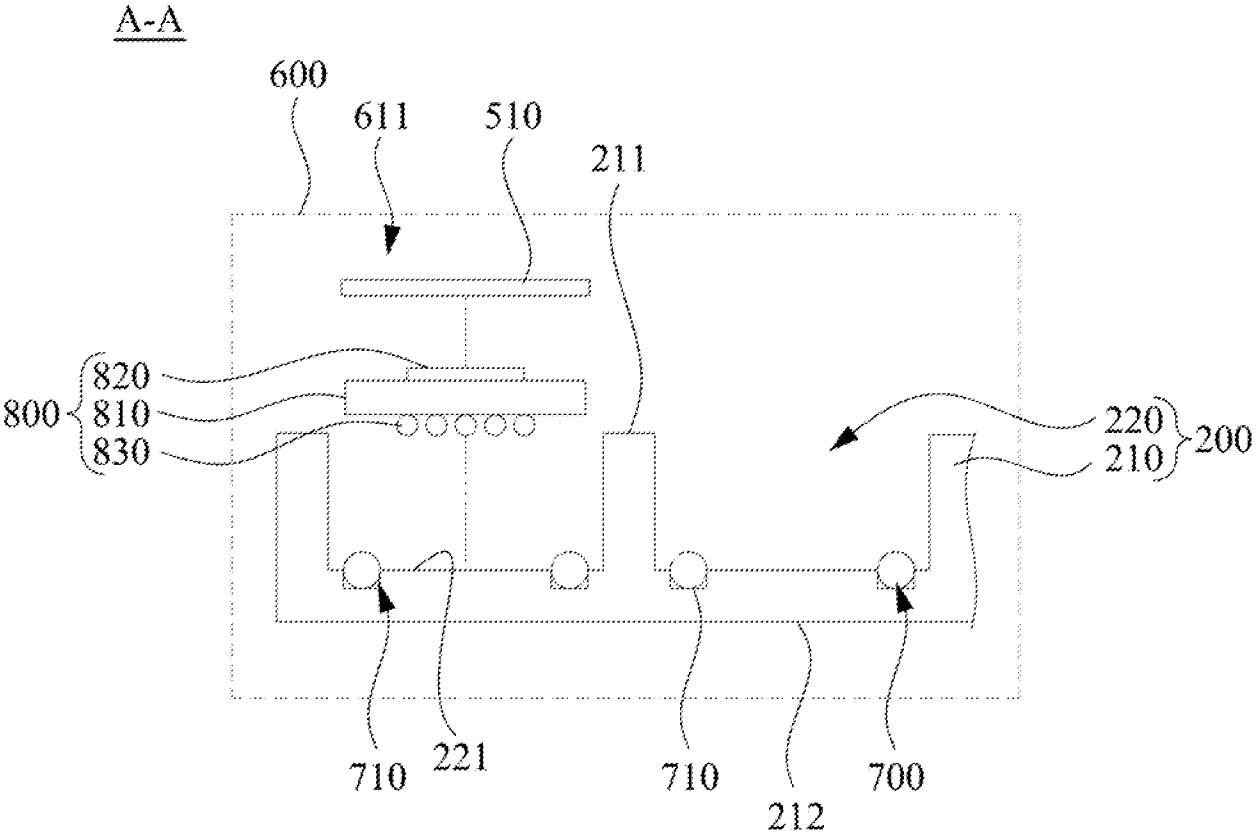
FIG. 2 is a partial cross-sectional view of the chip storing device viewed along a line AA in FIG. 1.

Reference is now made to FIG. 1 to FIG. 2, in which FIG. 1 is a top view of a chip storing device 10 according to one embodiment of the present disclosure, and FIG. 2 is a partial cross-sectional view of the chip storing device 10 viewed along a line AA in FIG. 1. As shown in FIG. 1 to FIG. 2, in this embodiment, the chip storing device 10 includes a supporting frame 100, an airtight container 600 and a plurality of first elastic airbags 700. The supporting frame 100 includes a first loading tray 200. The first loading tray 200 includes a first tray body 210 and a plurality of first receiving slots 220. The first tray body 210 includes a top surface 211 and a bottom surface 212 which are opposite to each other. The first receiving slots 220 are distributed on the top surface 211 of the first tray body 210. In this embodiment, the first receiving slots 220 are arranged in an array on the top surface 211 of the first tray body 210. Each of the first receiving slots 220 is used for containing a first packaged chip 800. For example, the first packaged chip 800 includes a substrate 810, a die 820 and solder balls 830. The solder balls 830 and the die 820 are respectively located on two opposite surfaces of the substrate 810, however, the disclosure is not limited to the structure of the first packaged chip 800. Each of the first receiving slots 220 further includes a plurality of positioning portions 230. More specifically, the positioning portions 230 are spaced distributed on the trough bottom 221 of each of the first receiving slots 220. Each of the positioning portions 230 is used to position-limit one of the first elastic airbags 700.

The airtight container 600 is formed with an accommodating space 611 therein. The aforementioned supporting frame 100 and the first elastic airbags 700 are completely received within the accommodating space 611. More specifically, the airtight container 600 includes a container body 610 and an air outlet 620. The container body 610 is provided with an accommodating space 611 that is sufficient to accommodate the above-mentioned supporting frame in 100. The air outlet 620 is located on one side of the container body 610 and in communication with the accommodating space 611. The air outlet 620 is used as an air sucking portion of the container body 610. When the air outlet 620 is closed, the accommodating space 611 is converted into an airtight space. However, the present disclosure is not limited that the airtight container 600 must have the air outlet 620.

Figure 3A:
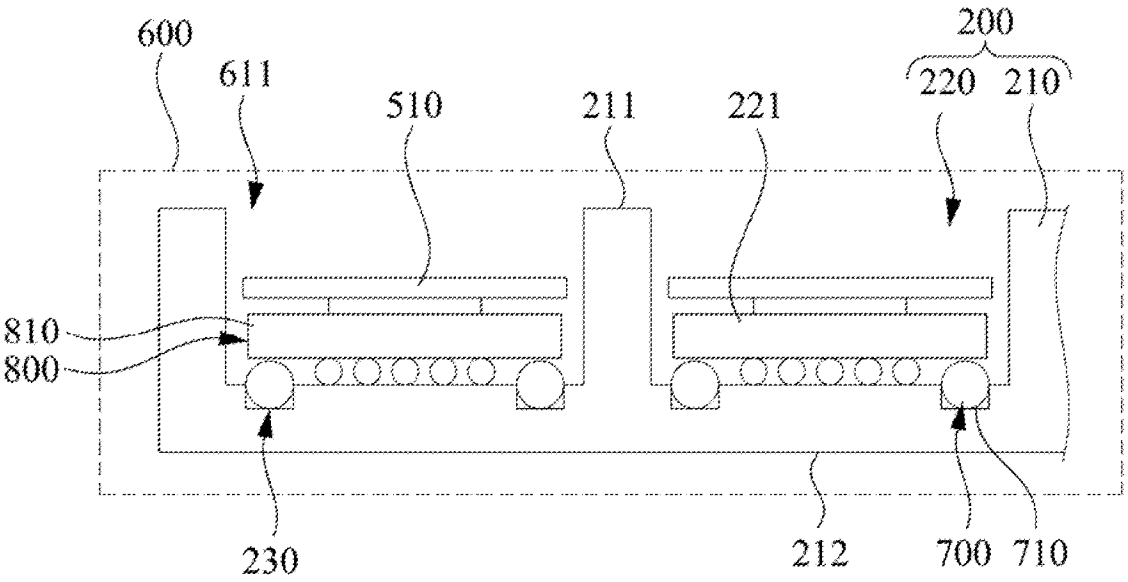
FIG. 3A and FIG. 3B are continuous operational views of the chip storing device of FIG. 2.
Figure 3B:
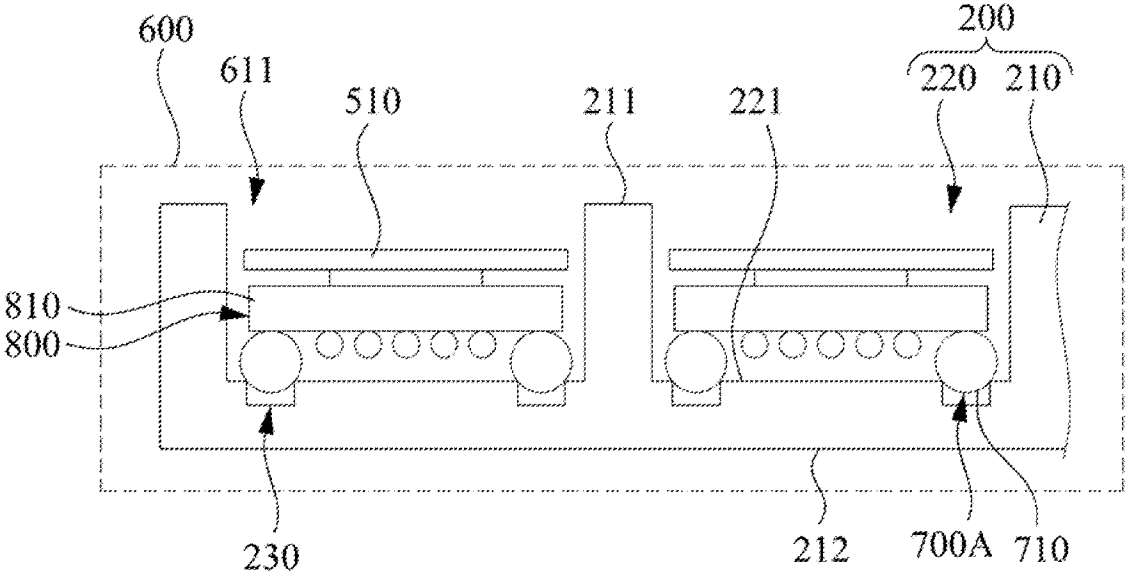

FIG. 3A and FIG. 3B are continuous operational views of the chip storing device of FIG. 2. Thus, as shown in FIG. 3A and FIG. 3B, under the condition of constant temperature, when the airtight container 600 is evacuated (pumped) or vacuumed from the air outlet 620 (FIG. 1), such that the accommodating space 611 is gradually converted into a negative pressure environment (e.g., 160 mmHg) from the standard pressure (e.g., 760 mmHg), volumes of the first elastic airbags 700 are gradually increased in the negative pressure environment according to Boyle's Law, and the first elastic airbags 700A that are inflated can directly abut against and lift the substrate 810 of the first packaged chip 800 finally, so that the first packaged chip 800 is far away from the trough bottom 221 of the first receiving slots 220, thereby reducing the risk of the substrate 810 of the first packaged chip 800 being worn.

It is noted, each of the positioning portions 230 can fixedly hold one of the first elastic airbags 700 that has been inflated or not. In this embodiment, each of the positioning portions 230 is, for example, a groove. However, the present disclosure is not limited thereto. In other embodiments, the positioning portion 230 may also be a hook, a magnetic attraction portion or a similar one.

More specifically, as shown in FIG. 1 and FIG. 3B, the trough bottom 221 of the first receiving slots 220 is, for example, rectangular, and the trough bottom 221 of the first receiving slots 220 includes a plurality (e.g., four) of corner portions 222. The positioning portions 230 are respectively located at the corner portions 222. Thus, the first elastic airbags 700A which are inflated can evenly lift the substrate 810 of the first packaged chip 800, thereby keeping the first packaged chips 800 away from the trough bottom 221 of the first receiving slots 220.

Furthermore, the supporting frame 100 further includes a plurality of first lid plates 510. The first lid plates 510 are removably covered the first packaged chips 800, respectively. More specifically, each of the first lid plates 510 is completely received within one of the first receiving slots 220, removably covered the top of the corresponding first packaged chip 800 in each of the first receiving slots 220, and disposed opposite to the trough bottom 221 in the first receiving slots 220. However, the present disclosure is not limited to the first lid plates 510 to be as an essential element.

Also, as shown in FIG. 2, the outer surface of the each of the aforementioned first elastic airbags 700 is coated with an electrostatic discharge (ESD) layer 710. Thus, as shown in FIG. 3B, when air in the above-mentioned accommodating space 611 is pumped to be in the negative pressure environment, the electrostatic discharge layer 710 of each of the first elastic airbags 700A that are inflated can perform electrostatic discharge on the first packaging chip 800, thereby reducing the risks of the package chip being damaged by static electricity.

In this embodiment, the airtight container 600 is a soft airtight bag, such as an aluminum foil bag, however, the present disclosure is not limited thereto, and the airtight container 600 can also be a rigid box or the like.

Figure 4A:
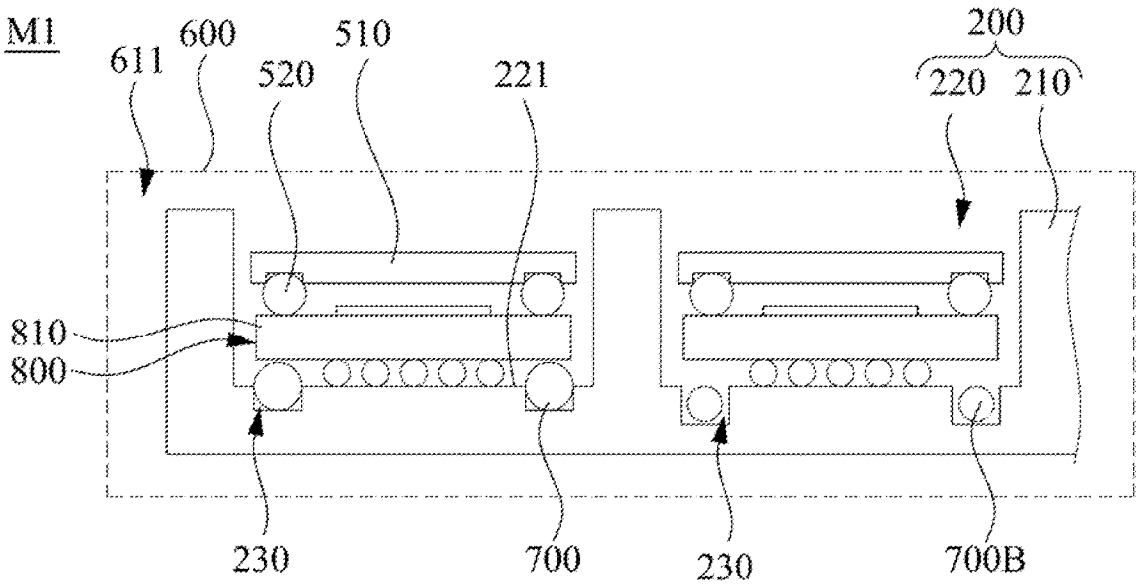
FIG. 4A and FIG. 4B are continuous operational views of a partial area of the chip storing device according to one embodiment of the present disclosure.
Figure 4B:
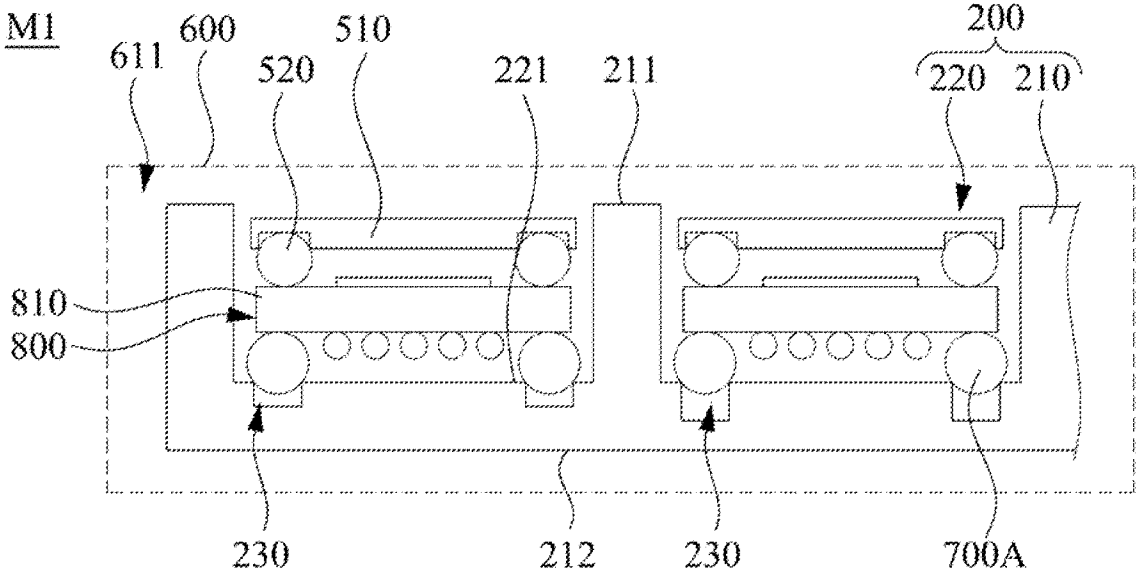

FIG. 4A and FIG. 4B are continuous operational views of a partial area M1 of the chip storing device according to one embodiment of the present disclosure. As shown in FIG. 4A and FIG. 4B, the chip storing device of the embodiment and the chip storing device 10 of FIG. 1 are substantially the same, except that one surface of each of the first lid plates 510 facing towards the corresponding first packaged chip 800 is provided with a plurality of elastomers 520. The elastomers 520 are fixed on the corresponding first lid plate 510 and spaced distributed thereon. It is noted, each of the elastomers 520 directly abuts against the substrate 810 of the first packaged chip 800, so that the first packaged chip 800 is sandwiched between the first elastic airbags 700A that are inflated and the elastomers 520. For example, each of the elastomers 520 may be an elastic airbag similar to the first elastic airbag 700. However, the present disclosure is not limited thereto. In other embodiments, the elastomers 520 may be a rubber pad, a foam or a solid ball whose volume does not change with air pressure.

Accordingly, as shown in FIG. 4A and FIG. 4B, when the accommodating space 611 is gradually converted into the negative pressure environment described above, volumes of the elastomers 520 and the first elastic airbags 700 are gradually increased in the negative pressure environment, and the first packaged chip 800 is finally directly sandwiched between the first elastic airbags 700A that are inflated and the elastomers 520 that are inflated, thereby reducing the risk of the substrate 810 of the first packaged chip 800 being worn by the corresponding first lid plate 510.

In addition, as shown in FIG. 4A, although each of the above-mentioned elastic airbags partially protrudes out of the corresponding groove, the present disclosure is not limited thereto, and in this embodiment, the above-mentioned first elastic airbag 700B can be modified to be completely located in the corresponding positioning portion 230 before the accommodation space 611 is converted into the negative pressure environment.

Figure 5A:
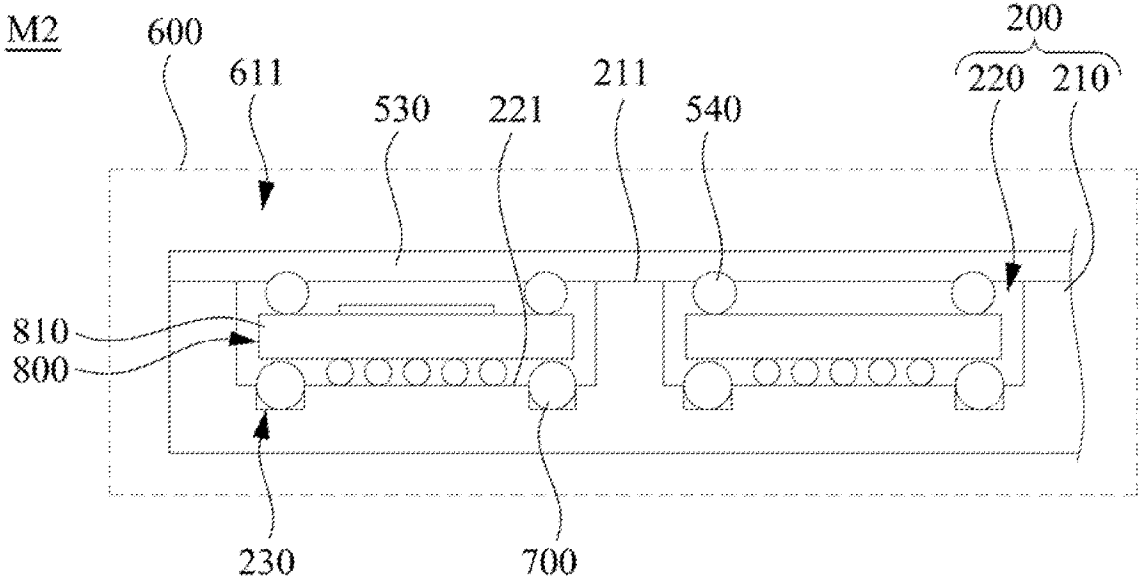
FIG. 5A and FIG. 5B are continuous operational views of a partial area of the chip storing device according to one embodiment of the present disclosure.
Figure 5B:
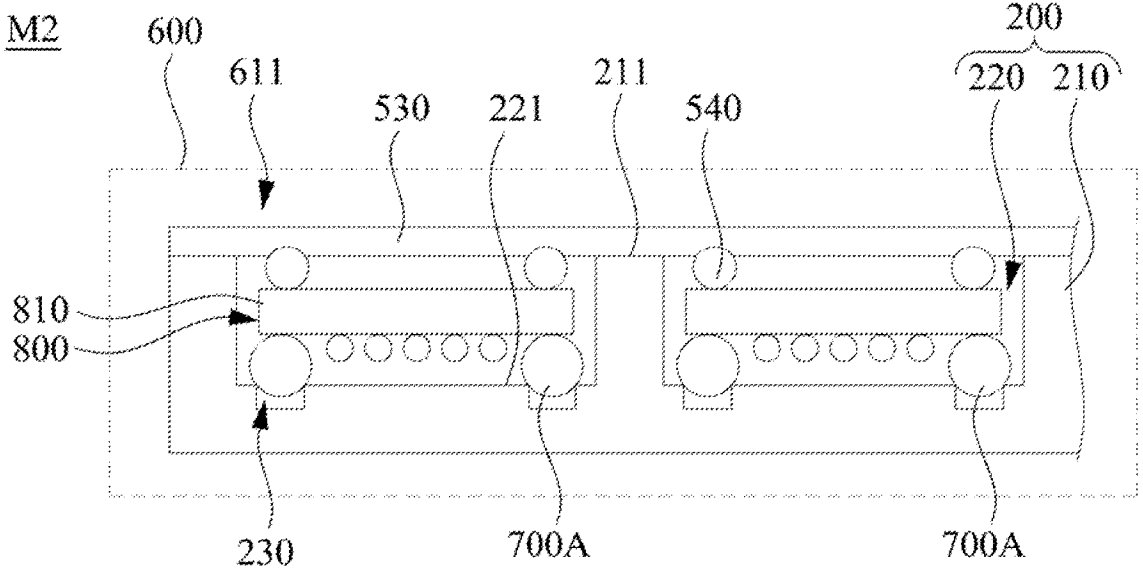

FIG. 5A and FIG. 5B are continuous operational views of a partial area M2 of the chip storing device according to one embodiment of the present disclosure. As shown in FIG. 5A and FIG. 5B, the chip storing device of the embodiment and the chip storing device 10 of FIG. 1 are substantially the same, except that the chip storing device is provided with a single second lid plate 530 for replaced by the first lid plates (FIG. 4A) described above. The second lid plate 530 covers the top surface 211 of the first tray body 210 and all of the first receiving slots 220. In addition, the second lid plate 530 includes a plurality of elastomers 540. The elastomers 540 are respectively fixed on one surface of the second lid plate 530 facing towards the first tray body 210, and the elastomers 540 are spaced distributed on the second lid plate 530.

It is noted, each of the elastomers 540 extends into the first receiving slots 220 and directly abuts against the substrate 810 of the first packaging chip 800, so that the first packaging chip 800 is sandwiched between the elastomers 540 and the first elastic airbag 700. For example, each of the elastomers 540 may be a rubber pad, a foam or a solid ball whose volume does not change with air pressure. However, the present disclosure is not limited thereto. In other embodiments, the elastomers 540 may be an elastic airbag similar to the first elastic airbag 700.

Thus, as shown in FIG. 5A and FIG. 5B, when the accommodating space 611 is gradually converted into the above-mentioned negative pressure environment, the volume of the first elastic airbag 700 is gradually increased, and finally the first packaging chip 800 is directly clamped between the elastomers 540 and the first elastic airbags 700A (FIG. 5B) that are inflated, thereby reducing the risk of the substrate 810 of the first packaged chip 800 being worn by the second lid plate 530.

Figure 6A:
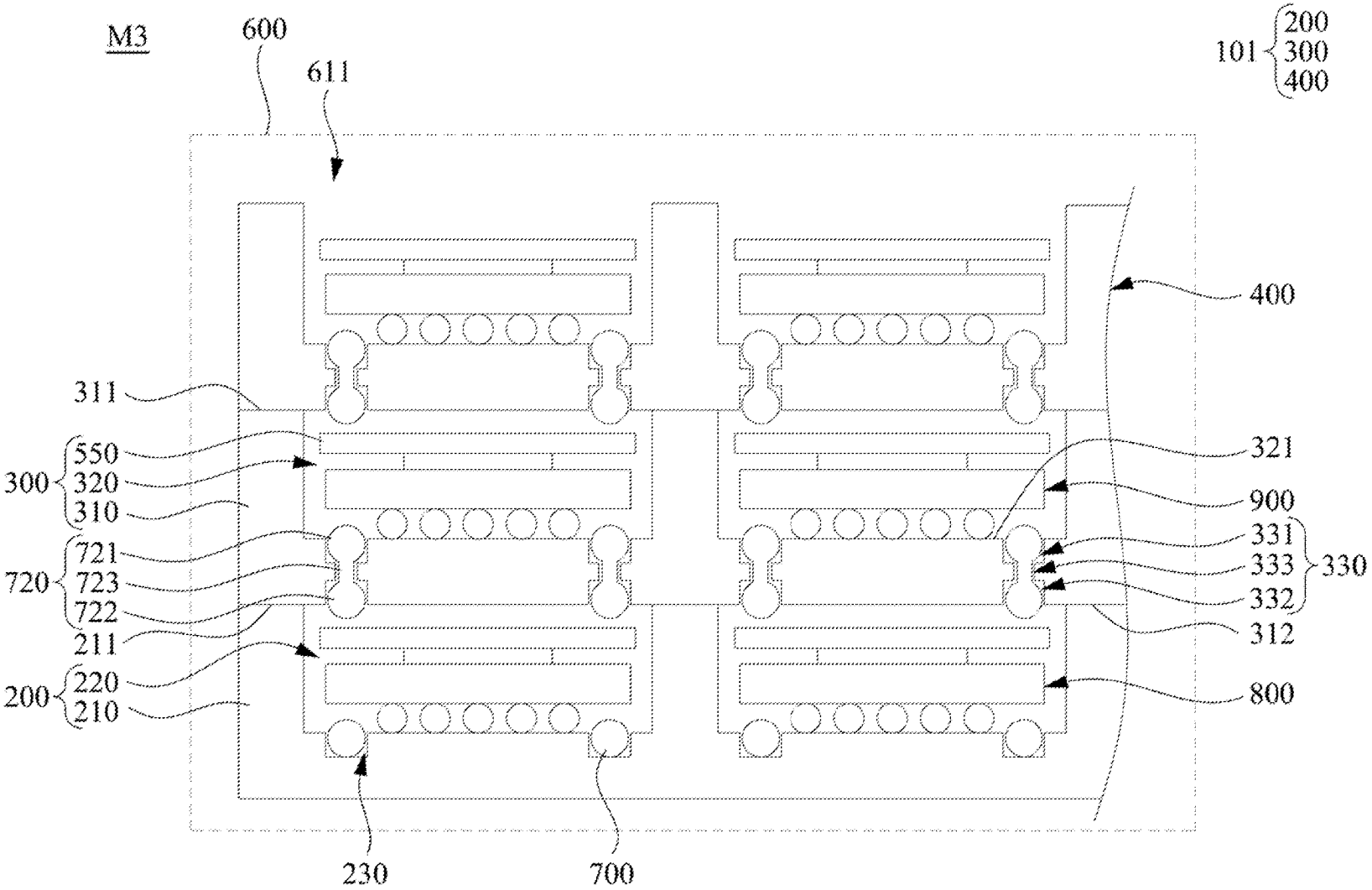
FIG. 6A and FIG. 6B are continuous operational views of a partial area of the chip storing device according to one embodiment of the present disclosure.
Figure 6B:
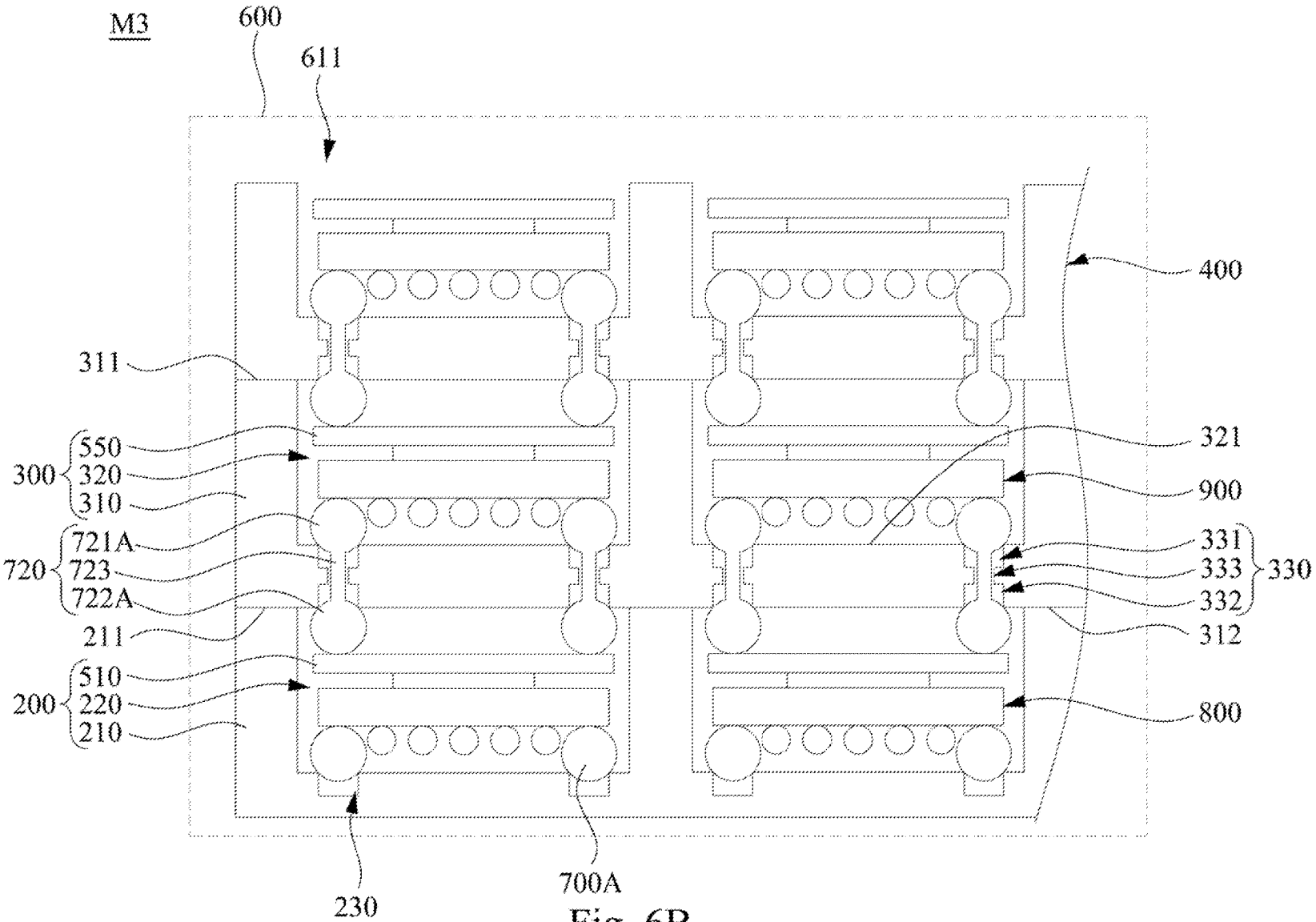

FIG. 6A and FIG. 6B are continuous operational views of a partial area M3 of the chip storing device according to one embodiment of the present disclosure. The chip storing device of the embodiment and the chip storing device of FIG. 4A are substantially the same, except that, as shown in FIG. 6A and FIG. 6B, the supporting frame 101 further includes a second loading tray 300 and the third loading tray 400. The first loading tray 200, the second loading tray 300 and the third loading tray 400 are stacked in sequence, and completely received within the accommodating space 611. The second loading tray 300 includes a second tray body 310, a plurality of second receiving slots 320 and a plurality of third lid plates 550. The second tray body 310 includes a top surface 311 and a bottom surface 312 which are opposite to each other.

More specifically, the second tray body 310 is stacked on the first tray body 210 so the bottom surface 312 is in contact with the top surface 211 (FIG. 4A) of the first tray body 210, and the second tray body 310 covers all of the first receiving slots 220 of the first tray body 210. The third loading tray 400 is stacked on the top surface 311 of the second tray body 310, and covers all of the second receiving slots 320 of the second tray body 310. These second receiving slots 320 are distributed on the top surface 311 of the second tray body 310. In this embodiment, the second receiving slots 320 are arranged in an array on the top surface 311 of the second tray body 310. Each of the second receiving slots 320 is used for containing a second packaged chip 900. The second packaged chip 900 may be the same as or different from the above-mentioned first packaged chip 800. The third lid plate 550 is removably covered the second packaged chip 900, the description of the third lid plate 550 is the same as that of the first lid plate 510, and the description of the third loading tray 400 is the same as that of the second loading tray 300, therefore, will not repeat again hereinafter.

Each of the second receiving slots 320 is formed with a plurality of penetration portions 330 therein. The penetration portions 330 are spaced distributed on the trough bottom 321 of each of the second receiving slots 320. For example, the penetration portions 330 are respectively located at the corner portions on the trough bottom 321 of each of the second receiving slots 320 (refer to the corner portions 222 in FIG. 1). Each of the penetration portions 330 is used to position-limit a cushioning element 720. In this embodiment, each of the penetration portions 330 includes a first groove 331 and a second groove 332 which are in communication to each other. The first groove 331 is in communication with the second receiving slot 320, and the second groove 332 is formed on a bottom surface 312 of the second tray body 310, and facing towards the first receiving slots 220. The cushioning element 720 includes a second elastic airbag 721 and a third elastic airbag 722 which are externally connected to each other. The second elastic airbag 721 and the third elastic airbag 722 are independent airbags, and their internal chambers are not communicated with each other. The second elastic airbag 721 is constrained in the first groove 331 of one of the penetration portions 330 of the second loading tray 300, and the third elastic airbag 722 is constrained in the second groove 332 of the corresponding penetration portion 330 of the second loading tray 300. The second tray body 310 is further provided with a channel 333. The channel 333 is located between the first groove 331 and the second groove 332 and in communication with the first groove 331 and the second groove 332.

In addition, the second elastic airbag 721 is directly connected to the third elastic airbag 722 through a connection portion 723, and the connection portion 723 is located in the channel 333. Thus, since the connection portion 723 is directly connected to the second elastic airbag 721 and the third elastic airbag 722 in the penetration portion 330, the second elastic airbags 721A that are inflated and the third elastic airbags 722A that are inflated will not be removed from the corresponding the first groove 331 and the corresponding second groove 332, respectively.

Therefore, when the accommodating space 611 is gradually evacuated (pumped) to be converted into the negative pressure environment described above, volumes of the first elastic airbags 700, the second elastic airbags 721 and the third elastic airbags 722 are gradually increased in the negative pressure environment according to Boyle's Law, so that the second elastic airbags 721A that are inflated can directly abut against and lift up the second packaged chip 900, and the third elastic airbags 722A that are inflated can abut against and push down the first lid plate 510 of the first loading tray 200. Thus, the first lid plate 510 and the first packaged chip 800 together are tightly sandwiched between the first elastic airbags 700A that are inflated and the third elastic airbags 722A that are inflated.

It is noted, in other embodiments, due to needs or limitations, the positioning portion 230 and the first elastic airbag 700 on the first loading tray 200 of this embodiment may also be replaced by the penetration portion 330 and the cushioning element 720.

Thus, through the construction of the embodiments above, the disclosure is able to reduce the risks of the package chip being cracked during the transportation/handling of the large-sized packaged chips, thereby reducing the transporting cost of packaged chips.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the present disclosure. In view of the foregoing, it is intended that the present disclosure cover modifications and variations of this disclosure provided they fall within the scope of the following claims and their equivalents.

What is claimed is:

1. A chip storing device for containing a packaged chip, comprising:

a supporting frame comprising a first loading tray having a first tray body, at least one first receiving slot and at least one positioning portion, the at least one first receiving slot is formed on a top surface of the first tray body, and the at least one positioning portion is disposed within the at least one first receiving slot;

at least one first elastic airbag is constrained on the at least one positioning portion; and an airtight container having an accommodating space therein, and the supporting frame and the at least one first elastic airbag is completely received within the accommodating space, wherein when the accommodation space is evacuated to be in a negative pressure environment, a volume of the at least one first elastic airbag is increased in the negative pressure environment, so that the at least one first elastic airbag that is inflated directly abuts against the packaged chip within the at least one first receiving slot.

2. The chip storing device of claim 1, wherein the supporting frame further comprises:

at least one lid plate removably covering the packaged chip; and at least one elastomer fixed on one surface of the at least one lid plate facing towards the packaged chip, wherein the packaged chip is used to be sandwiched between the at least one elastomer and the at least one first elastic airbag.

3. The chip storing device of claim 1, wherein the supporting frame further comprises at least one lid plate removably covering the packaged chip, wherein the at least one lid plate is completely received within the at least one first receiving slot; or the at least one lid plate covers the top surface of the first tray body and the at least one first receiving slot.

4. The chip storing device of claim 1, wherein the supporting frame further comprises:

at least one lid plate removably covering the packaged chip; and a second loading tray provided with a second tray body, at least one second receiving slot and at least one penetration portion, the second tray body that is stacked on the top surface of the first tray body and covering the at least one first receiving slot, the second receiving slot that is formed on a top surface of the second tray body for containing a another packaged chip, and the penetration portion penetrating the second receiving slot, and respectively connected to a trough bottom of the second receiving slot and a bottom surface of the second tray body.

5. The chip storing device of claim 4, further comprising:

at least one second elastic airbag, one part of the second elastic airbag that is disposed within the penetration portion, and another part thereof extending into the second receiving slot from the penetration portion;

at least one third elastic airbag, one part of the third elastic airbag that is disposed within the penetration portion, and another part thereof extending outwards the bottom surface of the second tray body from the penetration portion; and at least one connection portion that is directly connected to the second elastic airbag and the third elastic airbag, wherein when the accommodation space is evacuated to be in the negative pressure environment, a volume of the second elastic airbag and a volume of the third elastic airbag are increased so that the second elastic airbag that is inflated directly abuts against the another packaged chip located within the second receiving slot, and the third elastic airbag that is inflated directly abuts against the at least one lid plate located within the at least one first receiving slot.

6. The chip storing device of claim 2, wherein the at least one elastomer is one of a solid ball and an elastic airbag.

7. The chip storing device of claim 1, wherein a trough bottom of the at least one first receiving slot is provided with a plurality of corner portions, and the at least one positioning portion comprises a plurality of positioning portions that are located at the corner portions, respectively.

8. The chip storing device of claim 1, wherein the at least one positioning portion comprises a groove, wherein, before the accommodation space is in the negative pressure environment, the at least one first elastic airbag is completely received within the groove.

9. The chip storing device of claim 1, wherein the airtight container is one of a soft airtight bag and a rigid box.

10. The chip storing device of claim 1, wherein an outer surface of the at least one first elastic airbag is coated with an electrostatic discharge layer.

11. A chip storing device for containing a packaged chip, comprising:

an airtight container having an accommodating space therein;

a supporting frame comprising a plurality of loading trays stacked one another and completely received within the accommodating space, each of the loading trays comprising a tray body, at least one receiving slot, at least one penetration portion and at least one lid plate, the receiving slot is formed on a top surface of the tray body, the penetration portion is disposed on a trough bottom of the receiving slot, and provided with a first groove and a second groove which are in communication to each other, the first groove is in communication with the receiving slot, and the second groove that is formed on a bottom surface of the tray body, and the at least one lid plate removably covering the packaged chip; and at least one cushioning element comprising a first elastic airbag and a second elastic airbag which are connected to each other, the first elastic airbag is constrained on the first groove of one of the loading trays, and the second elastic airbag is constrained on the second groove of the one of the loading trays, wherein when the accommodation space is evacuated to be in a negative pressure environment, a volume of the first elastic airbag and a volume of the second elastic airbag are increased in the negative pressure environment, so that the first elastic airbag that is inflated directly abuts against the packaged chip within the one of the loading trays, and the second elastic airbag that is inflated directly abuts against the at least one lid plate located within another of the loading trays.

12. The chip storing device of claim 11, wherein the supporting frame further comprises:

at least one elastomer fixed on one surface of the at least one lid plate facing towards the packaged chip, wherein the packaged chip is used to be sandwiched between the at least one elastomer and the first elastic airbag.

13. The chip storing device of claim 12, wherein the at least one elastomer is one of a solid ball and an elastic airbag.

14. The chip storing device of claim 11, wherein the at least one lid plate is completely received within the receiving slot; or the at least one lid plate covers the top surface of the tray body and the receiving slot.

15. The chip storing device of claim 11, wherein the second elastic airbag is directly connected to the first elastic airbag through a connection portion.

16. The chip storing device of claim 11, wherein the trough bottom of the receiving slot is provided with a plurality of corner portions, and the penetration portion comprises a plurality of penetration portions that are located at the corner portions, respectively.

17. The chip storing device of claim 11, wherein before the accommodation space is in the negative pressure environment, the first elastic airbag is completely received within the first groove and the second elastic airbag is completely received within the second groove.

18. The chip storing device of claim 11, wherein the airtight container is one of a soft airtight bag and a rigid box.

19. The chip storing device of claim 11, wherein an outer surface of the first elastic airbag and an outer surface of the second elastic airbag are coated with an electrostatic discharge layer, respectively.

* * * * *